United States Patent [19]

Kaneko et al.

[11] Patent Number: 5,077,186

[45] Date of Patent: Dec. 31, 1991

[54] SILVER HALIDE PHOTOGRAPHIC LIGHT-SENSITIVE DYE CONTAINING ELEMENT

[75] Inventors: Satoshi Kaneko; Akira Tanaka; Minoru Ohashi, all of Nagaokakyo, Japan

[73] Assignee: Mitsubishi Paper Mills Limited, Tokyo, Japan

[21] Appl. No.: 578,614

[22] Filed: Sep. 7, 1990

[30] Foreign Application Priority Data

Sep. 7, 1989 [JP] Japan ..... 1-232330

[51] Int. Cl.[5] ..... G03C 1/84

[52] U.S. Cl. ..... 430/522; 430/581; 430/583; 430/588

[58] Field of Search ..... 430/522, 581, 588, 583

[56] References Cited

U.S. PATENT DOCUMENTS 4,839,265 6/1989 Ohno et al. ..... 430/522

4,960,686 10/1990 Hawashima et al. ..... 430/522

FOREIGN PATENT DOCUMENTS 62-123454 6/1987 Japan .

*Primary Examiner*—Jack P. Brammer

*Attorney, Agent, or Firm*—Cushman, Darby & Cushman

[57] ABSTRACT

Disclosed is a silver halide photographic light-sensitive material which has a hydrophilic colloid layer containing at least one of the dyes represented by the following formulas (I) and (II):

(I)

wherein $R^1$ and $R^2$ may be identical or different and each represents an alkyl group; $Y^1$ and $Y^2$ may be identical or different and each represents a group of atoms necessary to form a hydrocarbon ring together with the carbon atom at 3-position of indole ring; L represents a methine group; the dye molecule has at least three acid substituents; $X^{\theta}$ represents an anion; and n is 1 or 2 and is 1 when the dye form an inner salt, (II)

wherein $R_1$ and $R_2$ may be identical or different and each represents a substituted or unsubstituted alkyl group; $Z_1$ and $Z_2$ each represents a group of non-metallic atoms necessary to form a substituted or unsubstituted benzo condensed ring or naphtho condensed ring, with a proviso that $R_1$, $R_2$, $Z_1$ and $Z_2$ each represents a group which allows the dye molecule to have at least three acid groups; L represents a substituted or unsubstituted methine group; and n is an integer of 1-3.

3 Claims, No Drawings

SILVER HALIDE PHOTOGRAPHIC LIGHT-SENSITIVE DYE CONTAINING ELEMENT

BACKGROUND OF THE INVENTION

The present invention relates to a silver halide photographic light-sensitive material and in particular to a silver halide photographic light-sensitive material having a dyed hydrophilic colloid layer.

In silver halide photographic light-sensitive materials, it is often carried out for absorbing light of specific wavelength region to color photographic emulsion layer or other layers.

When it is necessary to control spectral composition of light which is to enter into photographic emulsion layer, a colored layer is provided at the position remoter from a support than the position of photographic emulsion layer.

Such colored layer is called a filter layer.

When a plurality of photographic emulsion layers are present as in multi-layer color light-sensitive materials, the filter layer may be positioned between these emulsion layers.

A colored layer is provided between photographic emulsion layer and support or on the side of support opposite to the side on which emulsion layer is present for the purpose of inhibiting blur of image, namely, halation which is caused by the phenomenon that light scattered at the time of passing through photographic emulsion layer or after transmitting therethrough is reflected at interface between emulsion layer and support or at the surface of light-sensitive material opposite to the surface on which the emulsion layer is present and again enters into the emulsion layer.

Such colored layer is called an antihalation layer. In case a plurality of photographic emulsion layers are present as in multi-layer color light-sensitive material, the antihalation layer may be provided between these layers.

Coloration of photographic emulsion layer is also carried out in order to inhibit reduction of sharpness of image caused by scattering of light in photographic light-sensitive layer (this phenomenon is generally called irradiation).

In many cases, these layers to be colored comprise hydrophilic colloid and so normally a water-soluble dye is contained in the layers for coloration thereof.

This dye must satisfy the following requirements.

(1) It has proper spectral absorption depending on use.

(2) It has sufficiently high absorbance.

(3) It is photographic-chemically inert. That is, it has no adverse effects in chemical sense on properties of silver halide photographic emulsion layer, for example, it does not cause reduction of sensitivity, fading of latent image and fogging.

(4) It does not cause changes with time such as discoloration during preparation of coating solution (photographic emulsion) and preparation and storage of emulsion.

(5) It does not result in difficulty in coating due to increase of viscosity when it is added to coating solution (photographic emulsion).

(6) It is decolored or dissolved and removed in the course of photographic processing and does not leave harmful coloration on photographic light-sensitive material after processing.

For satisfying these requirements, many dyes which absorb visible light or ultraviolet ray have been proposed.

Especially, for photographic elements sensitized for wavelength of 700 nm or less, triarylmethane dyes and oxonol dyes have been widely used for improvement of images as mentioned above.

On the other hand, recently it has been desired to develop antihalation dyes and anti-irradiation dyes which absorb infrared region for photographic light-sensitive materials as recording materials sensitized in infrared region, for example, those which record output of near infrared laser.

For example, as one method for exposing such photographic light-sensitive materials, there is known an image forming method so-called scanner system which comprises scanning an original and exposing silver halide photographic light-sensitive material according to the image to form negative image or positive image corresponding to the image of original.

Semiconductor laser is most advantageously used as light source of the scanner system. This semiconductor laser has the advantages that it is small in size; inexpensive; easy in modulation; longer in life than other He—Ne laser, argon laser and the like; and besides, emits light in infrared region and hence, when light-sensitive materials having sensitivity to infrared region is used, bright safe light can be used and thus handling properties become superior.

As dyes for photographic light-sensitive materials having sensitivity in infrared region, indoaniline dyes, dyes formed from 2-carbamoyl-1-naphthol and color developing agents, polymethine dyes and the like have been known which are disclosed, for example, in Japanese Patent Kokai Nos. 50-100116, 55-21094-21096, 61-174540, 62-3250, and 62-123454. However, these known dyes are not sufficiently long in their absorption wavelength for absorbing semiconductor laser beam of, for example, 780 nm, are low in stability with time, are insufficient in decoloration in the course of photographic processing, must be used in a considerably large amount for sufficient development of effect because of their low absorbance, may cause desensitization or increase of fog because they are photographic-chemically not inert, and increase viscosity of coating solution to result in difficulty in coating and thus none of them satisfy all of the above requirements (1)–(6). Therefore, there have been desired to develop dyes for photographic light-sensitive materials which make the best use of the characteristics of semiconductor laser which possesses excellent properties mentioned above.

SUMMARY OF THE INVENTION

Accordingly, an object of the present invention is to provide photographic light absorbing dyes which satisfy the above requirements and have excellent irradiation and halation inhibiting effects and filter effect.

Another object of the present invention is to provide silver halide photographic light-sensitive materials which have a hydrophilic colloid layer colored with water-soluble photographic light absorbing dyes which satisfy the above requirements and have excellent irradiation and halation inhibiting effects and filter effect.

DESCRIPTION OF THE INVENTION

As a result of intensive research conducted by the inventors, it has been found that dyes represented by the following formulas (I) and (II) are excellent dyes which satisfy the above requirements and meet the object of the present invention and that silver halide light-sensitive materials having a hydrophilic colloid layer containing at least one of the dyes represented by the formulas (I) and (II) also meet the object of the present invention.

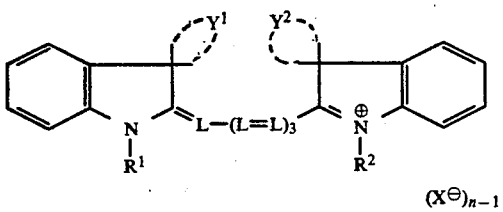

(I)

(wherein $R^1$ and $R^2$ may be identical or different and each represents an alkyl group, $Y^1$ and $Y^2$ may be identical or different and each represents a group of atoms necessary for forming a hydrocarbon ring together with the carbon atom at the 3-position of indole ring, and L represents a methine group, $x^{\ominus}$ represents an anion, n is 1 or 2 and is 1 when the dye forms an inner salt, and the dye molecule has at least three acid substituents).

Alkyl groups represented by $R^1$ and $R^2$ are preferably lower alkyl groups of 1–5 carbon atoms such as methyl, ethyl, n-propyl, isopropyl, n-butyl, and n-pentyl and may have substituents such as sulfonic acid, carboxylic acid and hydroxy. More preferably, they are lower alkyl groups of 1–5 carbon atoms having a sulfo group as acid substituent such as 2-sulfoethyl, 3-sulfopropyl and 4-sulfobutyl.

Hydrocarbon rings formed by $Y^1$ and $Y^2$ together with carbon atom of 3-position of indole ring are preferably 4-membered - 7-membered hydrocarbon rings such as cyclobutane, cyclopentane, cyclohexane, and cycloheptane and these rings may have substituents, for example, lower alkyl groups such as methyl and ethyl.

Methine group represented by L may have substituents, for example, alkyl groups of 1–5 carbon atoms such as methyl, ethyl, 3-hydroxypropyl, benzyl, and 2-sulfoethyl, halogen atoms such as F, Cl, and Br, aryl groups such as phenyl and 4-chlorophenyl, and lower alkoxy groups such as methoxy and ethoxy and furthermore, the substituents may link to each other to form a 6-membered ring containing the three methine groups such as 4,4-dimethylcyclohexene.

The dyes represented by the formula (I) have at least 3, preferably at least 4–6 acid substituents such as sulfo group and carboxy group. Especially preferred are those which have 4–6 sulfo groups. The acid substituents may be in the form of salts with alkali metals such as Na and K, ammonium salts or organic ammonium salts such as triethylammonium, tributylammonium and pyridinium.

Anions represented by $X^{\ominus}$ include, for example, halogen ions, p-toluenesulfonic acid ion, and ethylsulfuric acid ion. n represents 1 or 2 and it represents 1 when the dye forms inner salt.

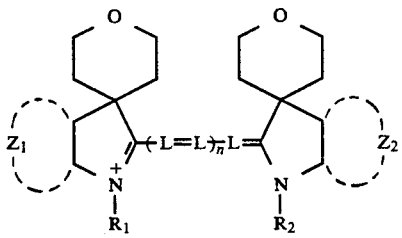

(II)

wherein $R_1$ and $R_2$ may be identical or different and each represents a substituted or unsubstituted alkyl group, $Z_1$ and $Z_2$ each represents a group of non-metallic atoms necessary for forming a substituted or unsubstituted proviso that $R_1$, $R_2$, $Z_1$ and $Z_2$ allow the dye molecule to have at least 3, preferably 4–6 acid substituents such as sulfonic acid group, carboxylic acid group and phosphoric acid group, more preferably 4–6 sulfonic acid groups.

In the present invention, sulfonic acid group means sulfo group and salt thereof and carboxylic acid group means carboxyl group and salt thereof. Example of salts are those of alkali metals such as Na and K, ammonium salts, and organic ammonium salts such as triethylammonium, tributylammonium, and pyridinum.

L represents a substituted or unsubstituted methine group.

$R_1$ and $R_2$ are preferably lower alkyl groups of 1–5 carbon atoms having sulfonic acid group such as 2-sulfoethyl group, 3-sulfopropyl group and 4-sulfobutyl group.

n is an integer of 1–3.

Substituents of benzo condensed ring or naphtho condensed ring formed by the group of non-metallic atoms represented by $Z_1$ and $Z_2$ include, for example, sulfo group, carboxy group, hydroxy group, halogen atoms such as F, Cl and Br, cyano group, substituted amino groups such as dimethylamino group, diethylamino group, ethyl-4-sulfobutylamino group and bis(3-sulfopropyl)amino group, and substituted or unsubstituted alkyl groups of 1–5 carbon atoms linked to the ring directly or through a divalent linking group such as methyl group, ethyl group, propyl group, and butyl group, the substituent being preferably sulfo group, carboxy group, and hydroxy group and the divalent linking group being preferably —O—, —NHCO—, —$NHSO_2$—, —NHCOO—, —NHCONH—, —COO—, —CO—, and —$SO_2$—.

Substituents of methine group represented by L include, for example, substituted or unsubstituted lower alkyl groups of 1–5 carbon atoms such as methyl group, ethyl group, 3-hydroxypropyl group, benzyl group, and 2-sulfoethyl group, halogen atoms such as F, Cl, and Br, substituted or unsubstituted aryl groups such as phenyl group and 4-chlorophenyl group, and lower alkoxy groups such as methoxy group and ethoxy group. Substituents of methine group represented by L may link to each other to form a 5- or 6-membered ring containing three methine groups such as 4,4-dimethylcyclohexene ring.

Silver halide photographic light-sensitive materials colored with the dye represented by the formula (I) or (II) have a high molecular extinction coefficient in the objective wavelength region, but show substantially no unwanted side absorptions in other wavelength region and furthermore, the dyes bring about no adverse effects on photographic characteristics such as fog and desensitization and can exhibit sufficient irradiation and halation inhibiting effects and filter effect with a small addition amount.

Furthermore, after development treatment, the dyes are completely and rapidly decolored and dissolved away from the light-sensitive materials and therefore, not only the dyes added for the above purpose do not remain, but also neither color stain caused by recoloration of the decolored dyes nor redyeing due to coloration after development are seen.

The dyes of the present invention have further advantages that they undergo no changes such as discoloration during preparation of dye solution and are not influenced by external conditions such as wet heat during preparation of photographic light-sensitive emulsion or subsequent storage and thus they are stable.

Further, when the dyes of the present invention are added to coating solution (of photographic emulsion), no increase in viscosity is recognized and no difficulty is seen in coating.

Typical examples of the dyes of the present invention represented by the formulas (I) and (II) are enumerated below, it being undersood that the present invention is never limited to these examples.

(I-1)

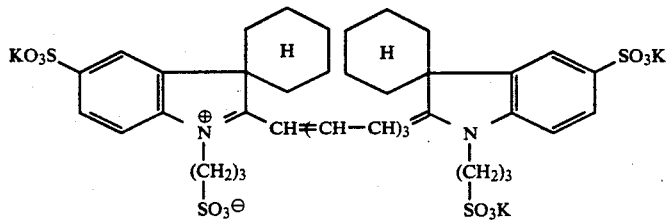

(I-2)

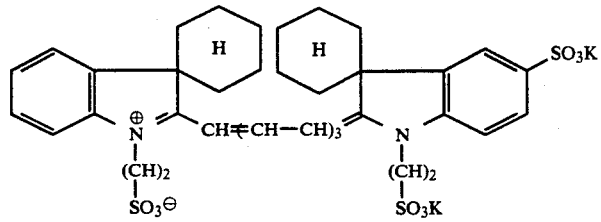

(I-3)

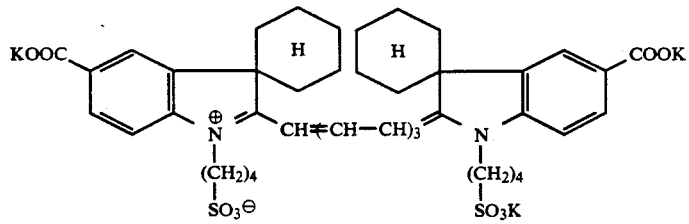

(I-4)

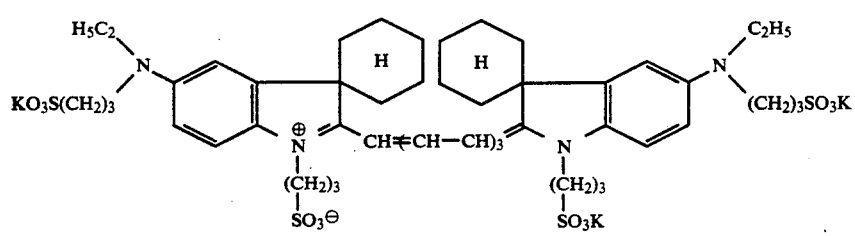

(I-5)

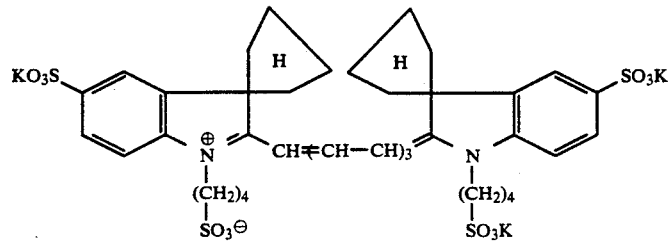

-continued
(I-6)
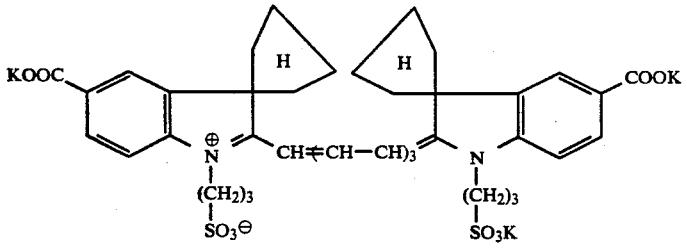
(I-7)
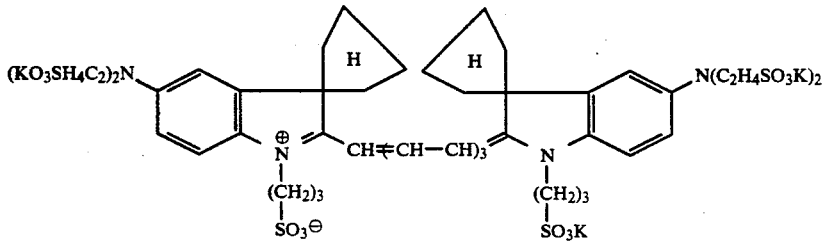
(I-8)
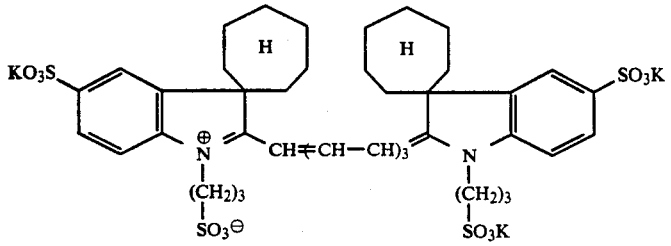
(I-9)
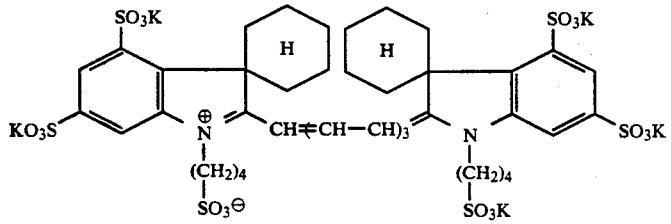
(I-10)
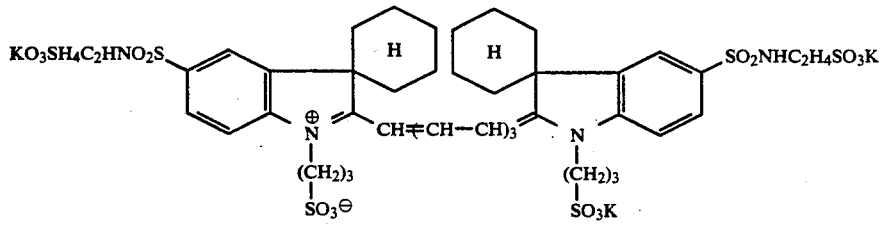
(I-11)
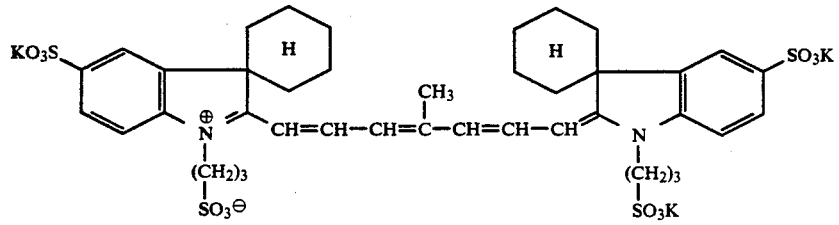

-continued
(II-1)
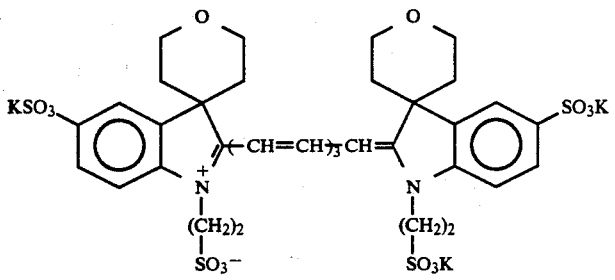
(II-2)
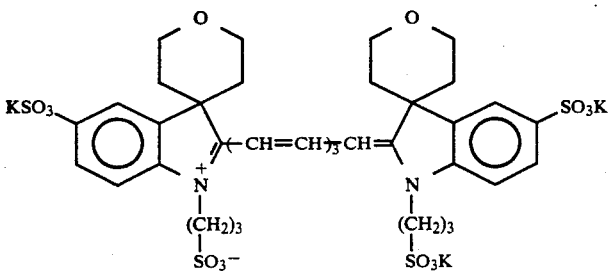
(II-3)
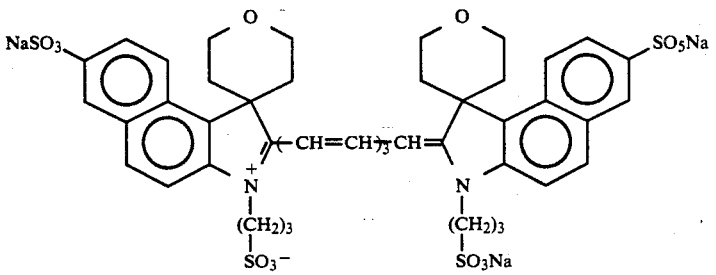
(II-4)
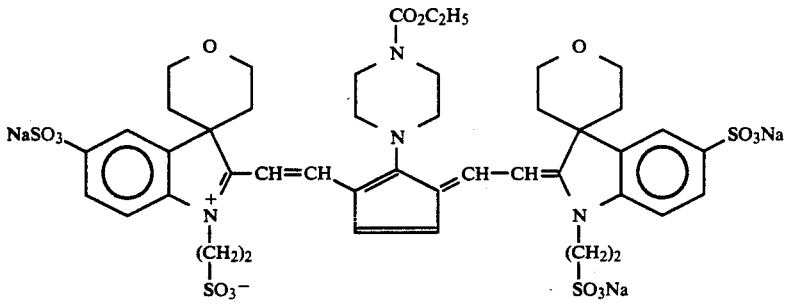
(II-5)
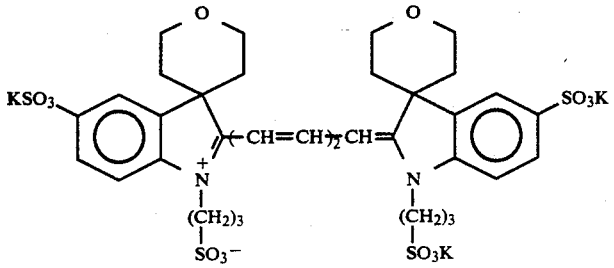

-continued
(II-6)
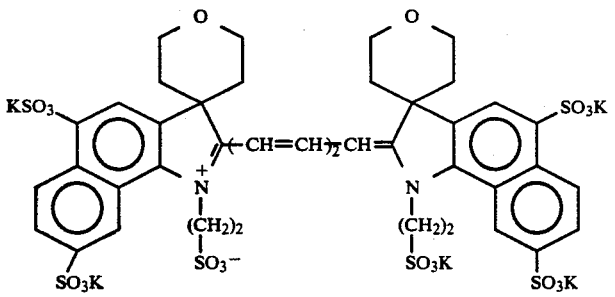
(II-7)
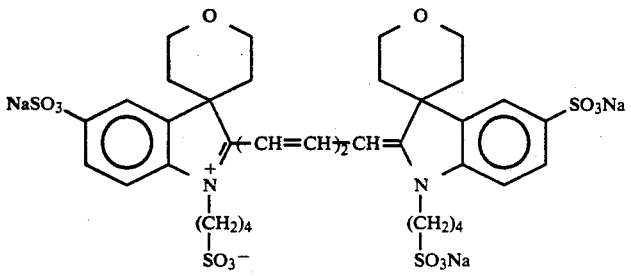
(II-8)
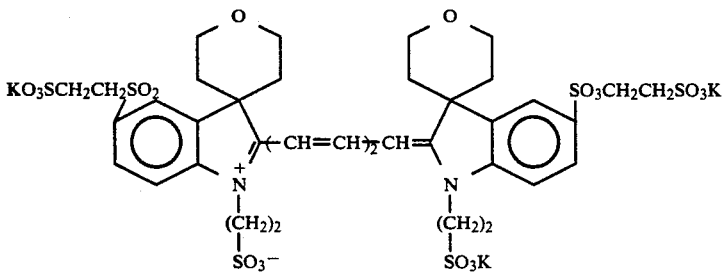
(II-9)
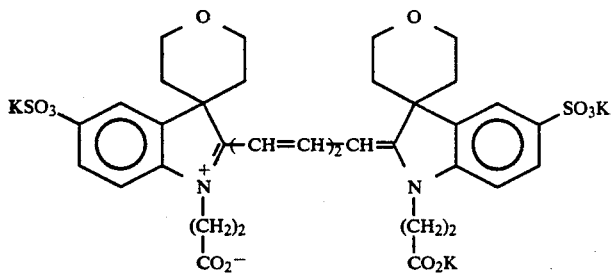
(II-10)
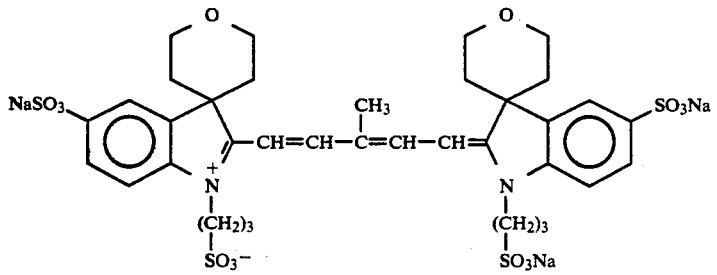

-continued (II-11)

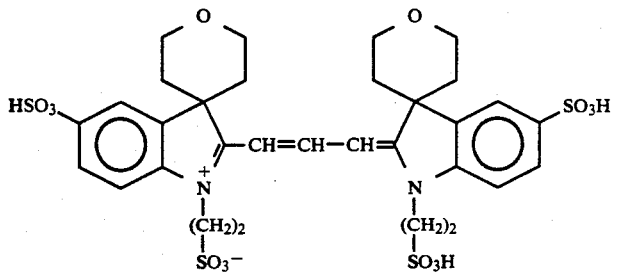

(II-12)

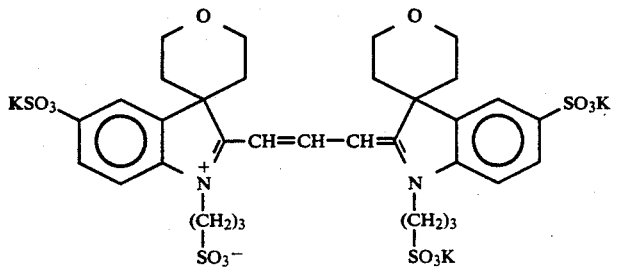

(II-13)

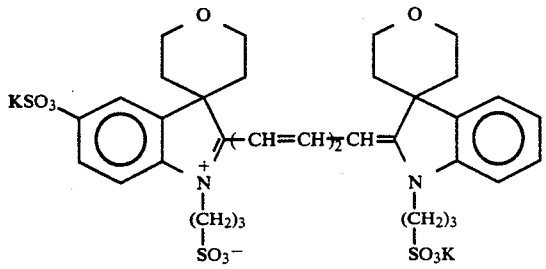

SYNTHESIS EXAMPLE 1

Synthesis of dye (I-1)

Step 1: Preparation of 2-methyl-5-sulfospiro[(3H)-indole-3,1'-dyclohexane]-triethyl ammonium salt.

6.69 ml of triethylamine was added to a solution prepared by dissolving 7.53 g of p-hydrazinobenzenesulfonic acid in 50 ml of methanol, followed by stirring at room temperature and then the solvent was evaporated under reduced pressure. To the residue was added 5.04 g of methylcyclohexyl ketone and then, 3 ml of acetic acid was added thereto, followed by heating at 85°-90° C. for 2 hours and then 40 ml of acetic acid was added, followed by refluxing under heating for 3 hours. Acetic acid was evaporated under reduced pressure and thereafter, 10.14 g of the desired product was isolated by silica gel chromatography.

Step 2: Preparation of anhydro-1,1'-di-(3-sulfopropyl)-5,5'-disulfospiro[(3H)-indole-3,1'-cyclohexane]tricarbocyanine hydroxide tripotasim salt.

To 5.0 g of the above obtained product was added 3.2 g of 1,3-propanesultone, followed by heating at 90°-100° C. for 2 hours. The mixture was left to stand for cooling and then, washed with ether and acetone and was added to 80 ml of methanol and 3.63 ml of triethylamine was added thereto. To the solution were added 2.22 g of glutacondialdehydedianil hydrochloride and 2 ml of acetic anhydride, followed by stirring overnight at room temperature. To the reaction mixture was added a solution prepared by dissolving 6.4 g of potassium acetate in 60 ml of ethanol, followed by refluxing under heating for 15 minutes. This was left to stand to cool and then the precipitated crystal was collected by filtration, washed with ethanol, and recrystallized from hydrous ethanol to obtain 4.60 g of the desired dye. Melting point: 280° C. (dec).

$\lambda_{methanol}^{max}=760$ nm.

$\epsilon H_2O=2.29\times10^5$.

SYNTHESIS EXAMPLE 2

Synthesis of dye (II-2)

Step 1: Preparation of 2-methyl-5-sulfospiro[3H-indole-3,4'-tetrahydropyran]-triethyl ammonium (salt)

9.8 ml of triethylamine was added to a solution of 6.59 of p-hydrazinobenzenesulfonic acid in 30 ml of methanol to obtain a homogeneous solution. Then, to the solution was added 4.49 g of 4-acetyltetrahydropyran and refluxed for 1 hour. The solvent was evaporated under reduced pressure, followed by adding 30 ml of acetic acid and refluxing for 30 hours. Acetic acid was evaporated under reduced pressure and 7.1 g of desired oily product was isolated by silica gel column chromatography.

Step 2:

1.76 g of the above intermediate and 1.22 g of 1,3-propanesultone were heated at 120°-130° C. for 3 hours. After left to stand for cooling, they were washed with ether and then dissolved in 30 ml of methanol. Thereto were added 1.40 ml of triethylamine and then 0.71 g of glutacondialdehydedianil hydrochloride and 0.7 ml of acetic a hydride, followed by stirring for 5 hours at room temperature. Thereto was added a solution of 2.46 g of potassium acetate in 30 ml of ethanol and refluxed for 15 minutes and then temperature was returned to room temperature. Thereafter, the precipitated crystal was collected by filtration and washed with water and recrystallized from hydrous ethanol to obtain 0.9 g of the desired dye. Melting point; 300° C. or higher.

$\lambda_{max}^{H2O}$ 757 nm.

$\epsilon H_2O = 2.30 \times 10^5$.

Other dyes represented by the formulas (I) and (II) can be easily synthesized in accordance with the above synthesis examples.

For adding the dye of the present invention represented by the formula (I) or (II) to silver halide photographic emulsion or protective colloid solution, it can be added in the form of an aqueous solution or a solution in methanol, ethanol, cellosolves, glycols, dimethylformamide or the like or a mixed solution in the organic solvent and water to emulsion layer, backcoat layer, subbing layer, interlayer, protective layer, ultraviolet absorbing layer or the like and can be allowed to exist therein.

Addition amount of the dye varies depending on the photographic layers to which it is added, but is generally 5-1,000 mg per 1 $m^2$ of light-sensitive material.

Silver halide photographic emulsion used in the present invention includes, for example, silver chloride, silver bromide, silver chlorobromide, silver iodobromide and silver chloroiodobromide.

Furthermore, the silver halide photographic emulsion is spectrally sensitized with normally used cyanine dyes, merocyanine dyes, and the like which are disclosed, for example, in Japanese Patent Kokai Nos. 59-191032, 59-192242, and 62-108241. Furthermore, the emulsion may contain basic mordants such as polymers containing amino group or ammonium group and polymers having nitrogen-containing heterocyclic ring, stabilizers and precursors thereof, surface active agents, hardeners, ultraviolet absorbers, fluorescent brighteners, and developing agents and precursors thereof. These can be added by known methods.

When silver halide photographic emulsion is used in color light-sensitive material, it may contain color coupler or dispersant therefor.

Protective colloid for silver halide emulsion may contain, in addition to gelatin, gelatin derivatives such as phthalated gelatin and malonated gelatin, water-soluble polymers such as polyvinyl alcohol and polyvinyl pyrrolidone, plasticizers for dimensional stabilization, latex polymers, and the like.

Furthermore, the silver halide emulsion may be coated on a support such as baryta paper, resin-coated paper, synthetic paper, or natural or synthetic polymer film such as cellulose triacetate or polyester type.

The present invention will be explained in more detail by the following examples.

EXAMPLE 1

1.55 g of gelatin was added to 15.0 ml of water to be swollen and then dissolved by heating to 40.0° C. To this gelatin solution were added an aqueous solution of the dye of the present invention or an aqueous solution of comparative dye referred to hereinafter ($2.0 \times 10^{-4}$ mole/2.0 ml of water, respectively), hardener and surface active agent and furthermore water was added thereto to make up 40 ml in total amount. Then, this colored solution was coated on a subbed polyester film base at a coating amount of 80 g/$m^2$.

The resulting samples were heated at 50° C. for 1 day.

Each of the samples was immersed in D-72 developer of 30° C. for 5 seconds and 15 seconds and then washed with running water for 10 seconds and was put between filter papers to absorb water drops present on the sample and dried to obtain a processed sample.

Optical density of the sample and the processed sample at λ max at 600-900 nm and change of density were measured by two-wavelength/double-beam autographic spectrophotometer (UV-3000) manufactured by Shimadzu Seisakusho Ltd.

The results obtained are shown in Table 1.

Comparative dye A

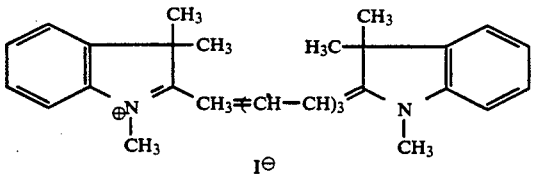

Comparative dye B

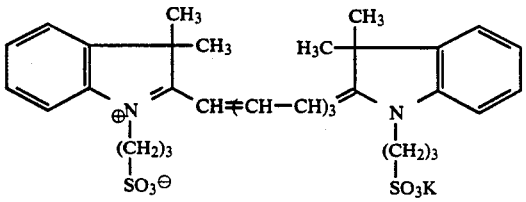

Comparative dye C

-continued

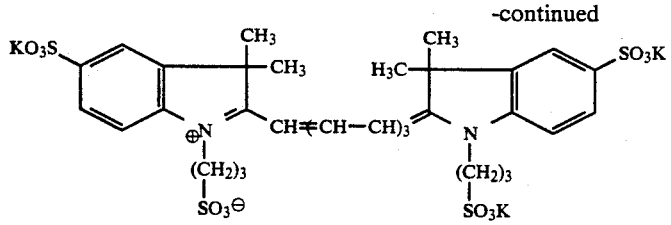

Comparative dye D

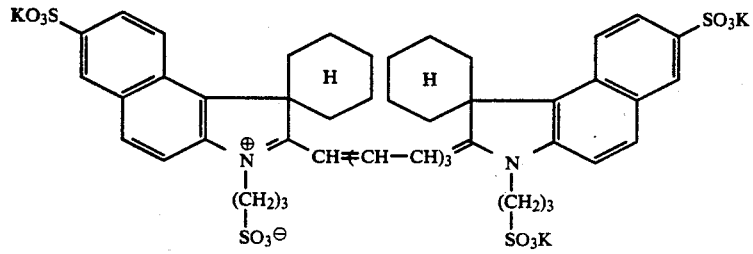

TABLE 1

| Sample | Dye | Optical density before processing (OD/λmax) | Optical density after processing (OD/λmax) 5 sec | 15 sec | Color retention (%) |
|---|---|---|---|---|---|
| 1 | (I-1) | 3.05 | 0.07 | 0.03 | 0.98 |
| 2 | (I-5) | 3.02 | 0.06 | 0.03 | 0.99 |
| 3 | A | 2.56 | 1.93 | 1.90 | 74.2 |
| 4 | B | 3.28 | 1.88 | 1.44 | 43.9 |
| 5 | C | 2.93 | 0.09 | 0.04 | 1.36 |
| 6 | D | 2.36 | 1.74 | 1.37 | 58.0 |

$$\text{Color retention (\%)} = \frac{\text{OD value } (\lambda max) \text{ after processing for 15 seconds}}{\text{OD value } (\lambda max) \text{ before processing}} \times 100$$

It can be seen from Table 1 that dyes (I-1) and (I-5) of the present invention are superior to comparative dyes A–D in optical density before processing and color retentivity after processing.

EXAMPLE 2

Silver iodobromide emulsion was prepared using a rhodium salt in such an amount to give high contrast of image and then chemically ripened. Thereafter, near infrared sensitizing dye, stabilizer, hardener and surface active agent were added to make up the emulsion. This emulsion was coated together with a gelatin coating solution for protective layer on a polyethylene laminated paper at a coating amount of 2.5 g/m$^2$ in terms of silver. This was a blank sample.

Six samples were prepared in the same manner as in preparation of the blank sample except that the dyes used in Example 1 were added to emulsion layer in an amount of 0.02 mmol/m$^2$.

Each of the thus obtained samples was exposed to semiconductor laser beam of 780 nm and subjected to development with PQ developer at 30° C. for 25 seconds and fixing, washing with water, and drying by an automatic processor.

Quality of image was evaluated by the five grades of from (1: Very bad with many fringes) to (5: Very sharp image with no fringe). Evaluation of color retentivity was conducted by the five grades of (1: Very much color retention) to (5: No color retention). The results are shown in Table 2.

TABLE 2

| Sample | Dye | Image quality | Colors retentivity | Relative sensitivity | Fog |
|---|---|---|---|---|---|
| Blank | No | 1 | 5 | 100 | 0.03 |
| 1 | (I-1) | 4 | 5 | 81 | 0.03 |
| 2 | (I-5) | 4 | 5 | 80 | 0.03 |
| 3 | A | 2 | 2 | 62 | 0.06 |
| 4 | B | 3 | 3 | 69 | 0.05 |
| 5 | C | 3 | 5 | 78 | 0.03 |
| 6 | D | 2 | 2 | 83 | 0.05 |

It can be seen from the results of Table 2 that samples 1 and 2 of the present invention were superior in quality of image, less in retention of color and underwent less adverse photographic effects.

EXAMPLE 3

1.55 g of gelatin was added to 25 ml of water to be swollen and then dissolved by heating to 40.0° C. To this gelatin solution were added an aqueous solution of the dye of the present invention or an aqueous solution of comparative dye referred to hereinafter ($1.0\times10^{-4}$ mol/2.0 ml of water, respectively), hardener and surface active agent and furthermore water was added thereto to make up 40 ml in total amount. Then, this colored solution was coated on a subbed polyester film base at a coating amount of 80 g/m$^2$ and these were heated at 40° C. for 1 day and cut to a rectangle of $8.0\times11.5$ cm$^2$ to obtain samples. Each of the samples was immersed in D-72 developer of 30.0° C. for 5 seconds and 15 seconds and then washed with running water for 10 seconds. Then, the sample was put between filter papers to absorb water drops present on the sample and dried to obtain a processed sample.

Optical density of the sample and the processed sample at λmax at 400–800 nm and change of density were measured by two-wavelength/double-beam autographic spectrophotometer (UV-3000) manufactured by Shimadzu Seisakusho Ltd.

The results obtained are shown in Table 3.

As is clear from Table 3, the dyes of the present invention are superior to Comparative Dyes E–G in optical density before processing and color retention after processing.

Comparative dye E

-continued

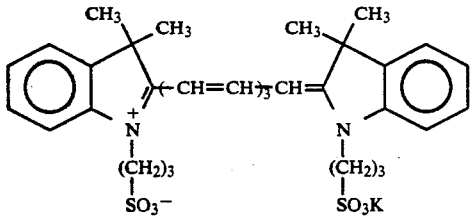

Comparative dye F

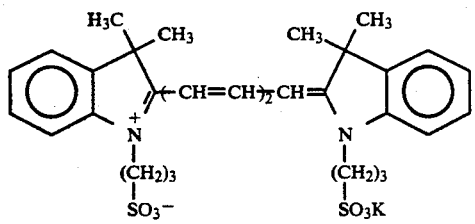

Comparative dye G

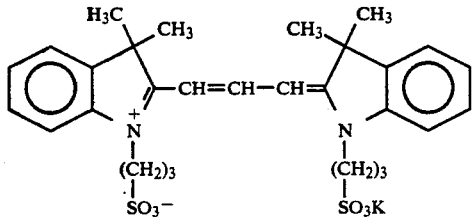

TABLE 3

| Sample | Dye | Optical density before processing (OD/λmax) | Optical density after processing (OD/λmax) 5 sec | 15 sec | Color retention (%) |
|---|---|---|---|---|---|
| 1 | II-1 | 2.20 | 0.05 | 0.02 | 0.91 |
| 2 | II-2 | 2.16 | 0.04 | 0.02 | 0.93 |
| 3 | II-5 | 1.90 | 0.04 | 0.02 | 1.05 |
| 4 | II-10 | 1.80 | 0.04 | 0.02 | 1.11 |
| 5 | II-12 | 1.65 | 0.04 | 0.02 | 1.21 |
| 6 | E | 2.10 | 2.01 | 1.75 | 83.3 |
| 7 | F | 1.86 | 1.76 | 1.61 | 86.6 |
| 8 | G | 1.61 | 1.40 | 1.29 | 80.1 |

$$\text{Color retention (\%)} = \frac{\text{OD value (}\lambda\text{max) after processing for 15 seconds}}{\text{OD value (}\lambda\text{max) before processing}} \times 100$$

EXAMPLE4

1% Aqueous solution of the dye used in Example 3 was added to a 10% aqueous gelatin solution so that optical density of 1.0 can be obtained when the mixture is coated in the form of a layer of 80 g/m$^2$. Thereto were added 5 ml of a 10% aqueous saponin solution and 1.5 ml of 10% formalin per 150 ml of the aqueous gelatin solution. Using the resulting colored aqueous gelatin solution, a hardened coating layer of optical density of 1.0 was obtained in the same manner as in Example 3. A pure silver bromide emulsion was coated on this coating layer and was developed with a developer of the following composition at 20° C. for 90 seconds and then fixed, washed with water and dried by conventional method.

Optical density of the processed film obtained was measured by the method carried out in Example 3 to find that densities of the samples containing the dye of the present invention after processing were all 0.02. (base density was 0.02).

| Composition of developer | |
|---|---|
| Metol | 3 g |
| Sodium sulfite | 45 g |
| Hydroquinone | 12 g |
| Sodium carbonate (monohydrate) | 80 g |
| Potassium bromide | 2 g |
| Water to make up 1 liter in total | |

The samples containing the dye of the present invention were light-sensitive materials which showed no changes with time such as discoloration during preparation of aqueous solution and emulsion and storage and showed no adverse effects on photographic characteristics such as fogging and desensitization and had very excellent halation inhibiting effect.

What is claimed is:

1. A silver halide photographic light-sensitive element which comprises a support and a silver halide emulsion layer and a hydrophilic colloid layer, at least one on the layers containing at least one of the dyes represented by the following (I) and (II):

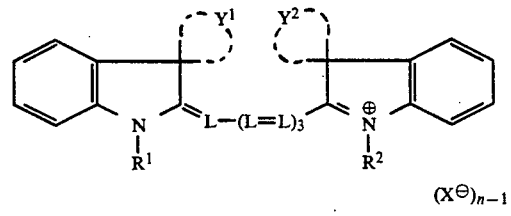

(I)

wherein $R^1$ and $R^2$ may be identical or different and each represents a substituted or unsubstituted alkyl group; $Y^1$ and $Y^2$ may be identical or different and each represent a group of atoms necessary to form a substituted or unsubstitued hydrocarbon ring together with the carbon atom at 3-position of indole ring; L represents a substituted or unsubstituted methine group; the dye molecule has at least three acid substituents; $X^{\ominus}$ represents an anion; and n is 1 or 2 and is 1 when the dye form an inner salt,

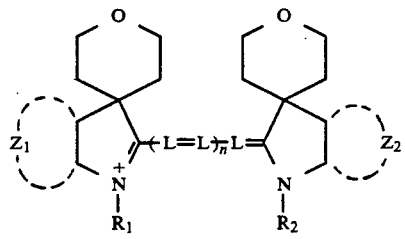

(II)

wherein $R^1$ and $R^2$ may be identical or different and each represents a substituted or unsubstituted alkyl group; $Z_1$ abnd $Z_2$ each represents a group of non-metallic atoms necessary to form a substituted or unsubstituted benzo condensed ring or naphtho condensed ring, with a proviso that $R_1$, $R_2$, $Z_1$ and $Z_2$ each represents a group which allows the dye molecule to have at least three acid groups; L represents a substituted or unsubstituted methine group; and n is an integer of 1–3; and wherein the content of the dye is 5–1,000 mg per 1 m$^2$ of the light sensitive element.

2. A silver halide photographic light-sensitive element according to claim 1, wherein the hydrocarbon rings formed by $Y^1$ and $Y^2$ in the formula (I) are 4-membered–7-membered hydrocarbon rings.

3. A silver halide photographic light-sensitive element according to claim 1, wherein the number of the acid substituents is 4 to 6.

* * * * *